US007047963B2

(12) United States Patent
Van Vleet

(10) Patent No.: US 7,047,963 B2
(45) Date of Patent: May 23, 2006

(54) APPARATUS AND METHOD FOR SIMULATED CAMPFIRE

(76) Inventor: Daniel W. Van Vleet, 525 1st St., Gurley, NE (US) 69141

( * ) Notice: Subject to any disclaimer, the term of this patent is extended or adjusted under 35 U.S.C. 154(b) by 472 days.

(21) Appl. No.: 09/817,522

(22) Filed: Mar. 26, 2001

(65) Prior Publication Data

US 2003/0164167 A1 Sep. 4, 2003

(51) Int. Cl.

| | |
|---|---|
| ***F24C 3/00*** | (2006.01) |
| ***F24C 5/00*** | (2006.01) |
| ***F24C 5/20*** | (2006.01) |
| ***F24B 1/181*** | (2006.01) |
| ***F24B 3/00*** | (2006.01) |

(52) U.S. Cl. ..... 126/512; 126/519; 126/92 A; 126/41 R; 126/25 R; 126/29; 126/38; 126/9 R; 126/9 B

(58) Field of Classification Search ..... 126/512, 126/519, 92 A, 41 R, 25 R, 29, 38, 9 R, 126/9 B See application file for complete search history.

(56) References Cited

U.S. PATENT DOCUMENTS

| | | | | |
|---|---|---|---|---|
| 254,709 | A | 3/1882 | Sheldon | |
| 1,713,659 | A | 5/1929 | Karr | |
| 2,113,012 | A | 4/1938 | Albrecht et al. | |
| 2,154,305 | A * | 4/1939 | Goerl | 126/38 |
| 2,482,797 | A | 9/1949 | Quinnell et al. | |
| 3,362,395 | A | 1/1968 | Peterson | |
| 3,385,651 | A | 5/1968 | Rasmussen et al. | |
| 3,409,000 | A | 11/1968 | Brader et al. | |
| 3,529,557 | A * | 9/1970 | Treanor | 126/25 B |
| 3,593,647 | A | 7/1971 | Copeland | |
| 3,630,189 | A | 12/1971 | Hodeges et al. | |
| 3,641,922 | A | 2/1972 | Stanley et al. | |
| 4,531,506 | A * | 7/1985 | Chambers et al. | 126/25 R |
| 4,651,708 | A | 3/1987 | Groeneweg | |
| 4,890,601 | A * | 1/1990 | Potter | 126/512 |
| 4,903,683 | A | 2/1990 | Larsen et al. | |
| 5,094,223 | A * | 3/1992 | Gonzalez | 126/25 R |
| 5,359,988 | A * | 11/1994 | Hait | 126/25 R |
| 5,404,864 | A * | 4/1995 | Kent, Jr. | 126/9 B |
| 5,413,087 | A | 5/1995 | Jean | |
| 5,421,321 | A | 6/1995 | Ward | |

(Continued)

FOREIGN PATENT DOCUMENTS

GB 2228791 A * 9/1990

*Primary Examiner*—Henry Bennett
*Assistant Examiner*—Nihir Patel
(74) *Attorney, Agent, or Firm*—Timothy J. Martin; Michael R. Henson

(57) ABSTRACT

A portable campfire apparatus has a base, a fire pan supported by the base, a gas manifold disposed in the fire pan and a quantity of low-density, non-flammable particulate material in the fire pan at a depth to cover the manifold. The fire pan and the base are substantially the same shape and size. A cylindrical spacer can be interposed between the fire pan and the base, and a lid of geometry similar to the base and fire pan is disclosed and rests on an inwardly projecting shoulder on the rim of the fire pan. When upright, the upper rim is parallel to the ground, but when tipped over the rim is at an angle of no less than ninety degrees to the ground. Different shapes of the base and fire pan are taught, and different configurations of the manifold are shown.

34 Claims, 5 Drawing Sheets

U.S. PATENT DOCUMENTS 5,868,128 A * 2/1999 Omar ..... 126/305
5,901,697 A * 5/1999 Oliver et al. ..... 126/92 AC
6,044,836 A * 4/2000 Oliver et al. ..... 126/92 AC
6,227,843 B1 * 5/2001 Pedersen et al. ..... 126/41 R
6,769,907 B1 * 8/2004 Doud ..... 431/350
6,926,517 B1 * 8/2005 Van Vleet ..... 431/125

* cited by examiner

APPARATUS AND METHOD FOR SIMULATED CAMPFIRE

FIELD OF THE INVENTION

The present invention broadly concerns camping and outdoor equipment. More particularly, the present invention is directed to portable campfires that generally can be used in any outdoor environment. Specifically, the present invention is directed a portable campfire apparatus and method that provides aesthetic pleasure while reducing risks to people and their environment. The present invention especially concerns a portable gas simulated campfire apparatus and method.

BACKGROUND OF THE INVENTION

In pre-historic times, humans depended on fire for survival. Fire provided light, warmth, protection from animals, and a means for cooking food. As a consequence of this reliance, humans also formed an intimate psychological connection with fire. Mysticism imparted certain spiritual and religious attributes to fire, gradually transforming the hearth into a place for social gathering. People congregated around open fires to interact with each other, dance, pray, and teach the new generation the history of the old. Arguably, these congregations helped to unify people and initiate the development of societies.

As time progressed, fire maintained a significant presence in the daily lives of people. Most homes were constructed with large fireplaces to serve as a source of light and heat, as well as a place to cook food. Humans discovered new and improved uses for fire. For example, gas lamps allowed fire to be portable and light areas without the need of an open fire. Fire also became used for tool making, weapons, and other articles of manufacture. In modern times, fire is still used as a source of light, heat, and means for cooking food. However, in general, its importance is diminished as compared to the past. Electricity has generally negated the need for fire as a source of light and open fires in fireplaces are typically not used as the primary source for heat or cooking. Generally, the modern home is furnished with electric or fuel heat, stoves, ovens, microwaves, and a variety of light fixtures.

For many people, the psychological bond with fire has endured all of these technological substitutes because they are generally enchanted by fire's esthetic qualities, its glow, its warmth, and even its smell. As a result, many homes continue to be constructed with fireplaces. Some homes have wood burning fireplaces while others are equipped with gas logs controlled by a remote on/off switch. In addition, many homes and dining tables are decorated with a variety of candles made of wax or decorative glass objects containing oils therein.

Fire is also present in the modern outdoor experience. Perhaps the most common of the modern outdoor experiences is cooking over an open flame on backyard barbecue grills. Oftentimes, backyard barbecues are associated with the gathering of friends and family for pleasurable occasions. Barbecue grills exist in a variety of forms including charcoal and gas grills. While some grills are permanently affixed to an area, others are designed to be transportable for grilling at tailgate parties, campgrounds, and the like. Those that enjoy cooking outdoors in more remote locations value lightweight, compact camping stoves that are easily stowed in backpacks. These camping stoves are typically gas fired so that the backpacker is not required to also carry wood or charcoals on the trip.

In addition to cooking outdoors, many people still enjoy gathering around open fires. At parties, some people build outdoor fires in their backyards or along beaches. Usually these outdoor fires serve as one of the party's main attractions, alluring people to its warmth and light just as it did in the past. For others, open fires are enjoyed in national parks or other wilderness areas around the world. These fires are built either in designated pits or near chosen campsites and are sometimes a setting for campers to roast marshmallows and tell stories. Unfortunately, it has become increasingly dangerous for people to enjoy open fires outdoors, especially in national parks and wilderness areas. Persistent dry weather during the summer months create land very susceptible to uncontrollable fires that endanger lives, homes and even ancestral treasures. Prohibitions on outdoor fires are becoming commonplace in many national parks and wilderness areas.

Accordingly, there remains a need to provide a new design and construction for an open fire that greatly reduces the risk of causing uncontrollable fires, while at the same time, provides other attributes of an open fire. There is a further need to provide a design and construction for an open fire that is portable for those who enjoy fire in national parks or other wilderness areas. The present invention is particularly directed to meeting these needs.

SUMMARY OF THE INVENTION

It is an object of the present invention to provide a new and useful campfire apparatus and method that is adapted to provide an open flame.

It is another object of the present invention to provide a camp stove and method adapted to create an open fire that is relatively free of embers.

A further object of the present invention is to provide a gas-fired camp stove that is portable yet provides an open flame in a relatively safe and convenient manner.

Yet another object of the present invention is to provide a camp stove that is gas powered to provide the appearance of open flames.

Yet another object of the present invention is to provide a camp stove that is easily manufactured and inexpensive in construction.

According to the present invention, then, a campfire apparatus is adapted to be placed in an assembled state on a support surface and connected to a source of fuel. Broadly, the campfire apparatus includes a base adapted to rest on the support surface when in an assembled state. A fire pan is adapted to be supported by the base when in the assembled state with the fire pan including a main body portion that has an inner surface, an upper rim and a pan interior. A gas manifold is then adapted to be disposed in the pan interior when in the assembled state. This gas manifold has at least one gas outlet operative to introduce vaporized fuel into the interior of the fire pan when connected to the source of fuel. A quantity of low density, nonflammable particulate material is adapted to be disposed in the fire pan at a depth sufficient to cover the gas manifold when in the assembled state.

The particulate material should be sufficient so that the vaporized fuel migrates upwardly therethrough without igniting until it reaches the surface of the particulate material when connected to a source of fuel. To this end, campfire apparatus has a connector associated with the gas manifold that is adapted to connect to the source of fuel. The source of fuel is in the form of a reservoir that is portable, such as a propane tank. In any event, the particulate material is selected from a group consisting of particles of materials such as silicates, carbonates, coarse sands and certain ores. A preferred particulate material is vermiculite.

A lid may also be provided with this lid being sized and adapted to enclose the pan interior when placed thereon in a mounted state. A portion of the lid is thus supported by a portion of the main body of the fire pan. To this end, the fire pan can include an inwardly projecting shoulder disposed in surrounding relation on the upper rim with this shoulder portion operative to support the lid when the lid is in a mounted state.

Preferably, the base, the fire pan and the lid have generally the same geometrical configuration so as to reduce manufacturing costs. A spacer may also be provided with this spacer adapted to be interposed between the fire pan and the base when in the assembled state so that the base supports the spacer and the spacer supports the fire pan. The base and the fire pan may be configured as a geometric shell selected from a group consisting of: a portion of a spherical shell, a truncated pyramidal shell, a rectangular parallelpiped shell, a polyhedral shell, a conical shell, a cylindrical shell and a pyramidal shell. The lid may also have substantially the same geometric structure as the fire pan and the base. It is desired that the base and the fire pan be sized so that the plane of the upper rim is oriented parallel to the support surface when in an upright position but, when tipped over, the plane of the upper rim is oriented at no less than 90° to the support surface so that the plane of the rim is oblique to the support surface. When assembled, it is desired that the fire pan, the base and the spacer have central axes that are co-linear. In assembly, one or more bolts interconnect the fire pan and the base with the spacer interposed therebetween. Here, bolts may extend between the base and the fire pan through the hollow interior of the spacer.

The gas manifold of the present invention can take a variety of selected sizes and shapes. For example, the manifold may be configured as in a toroidal, serpentine, linear or linearly angled shape. In some embodiments, the manifold is shaped so as to extend circumjacent to the inner surface of the fire pan when in the assembled state. The gas outlet is positioned to direct vaporized fuel laterally toward an axis that is perpendicular to the plane containing the rim of the fire pan, that is, radially inwardly into the particulate material. The gas outlet can be a single slit or channel extending around the manifold or, alternatively, can be a plurality of ports formed in spaced-apart relation to one another around the manifold thereby to define a plurality of gas outlets therefore.

The present invention is also directed to a method of providing an artificial camp fire on a support surface. This method includes a first step of providing a fire pan having an interior and wherein the fire pan includes a gas manifold disposed in the interior thereof with the manifold having at least one gas outlet operative to introduce vaporized fuel into the interior of the fire pan. Next, the fire pan is supported in spaced relation to the support surface such that the interior thereof is upwardly opening. The method includes the step of placing a quantity of low density, fire retardant particulate material in the fire pan at a depth sufficient to cover the gas manifold thereby to achieve a surface spaced completely above the gas manifold. The method then includes the step of introducing a fuel into the manifold at a pressure sufficient so that vaporized fuel is injected into the particulate material in a manner whereby the vaporized fuel migrates upwardly therethrough without igniting until it reaches the surface. The method then includes the step of igniting the vaporized fuel along the surface of the particulate material. The method may also include any step that is accomplished by the structure of the campfire apparatus described above.

These and other objects of the present invention will become more readily appreciated and understood from a consideration of the following detailed description of the exemplary embodiment of the present invention when taken together with the accompanying drawings, in which:

DETAILED DESCRIPTION OF THE EXEMPLARY EMBODIMENTS

The present invention is directed to a portable campfire apparatus or camping stove that provides the aesthetic attributes of an open campfire that is relatively safe and convenient to use, even in situations where open fires may otherwise present a danger to humans or the environment. This campfire apparatus may connect to a source of fuel and provides a non-ember producing flame. Moreover, the construction design is such so that it can be produced at relatively reduced costs so that it may be quite affordable to the consumer.

Figure 1:
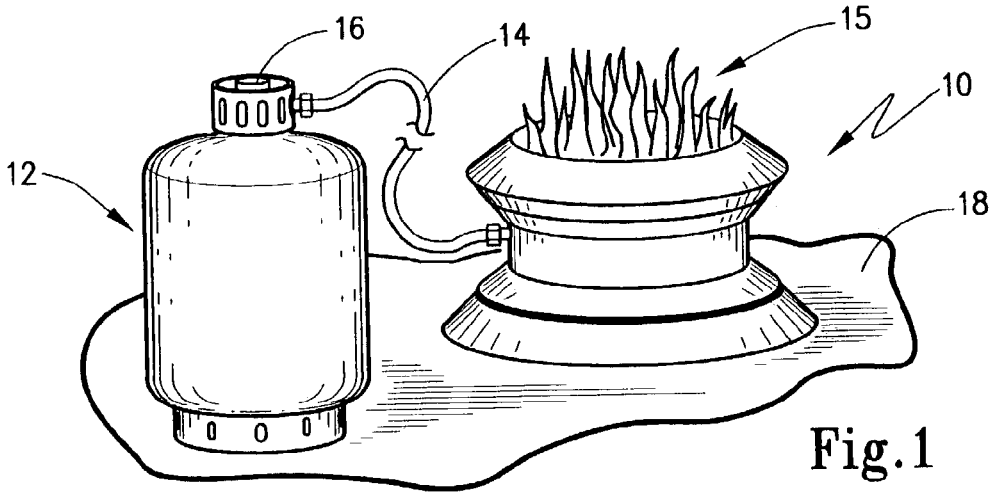
FIG. 1 is a perspective view showing the campfire apparatus of a first embodiment of the present invention attached to a portable fuel supply and in an operative condition.

With reference to FIG. 1, the campfire apparatus 10 is shown connected to a fuel canister 12 by means of a conduit 14. Campfire 10 as shown, in FIG. 1, in an operative apparatus wherein flames 15 are shown for representative purposes. Fuel canister 12 may be of any convenient type, but is preferably a propane canister having a valve 16 as is known in the art. Campfire apparatus 10, as well as fuel canister 12, is adapted to be placed in an upright position on a support surface 18 that may be any suitable surface, such as the ground, a patio, a deck or the like.

Figure 2:
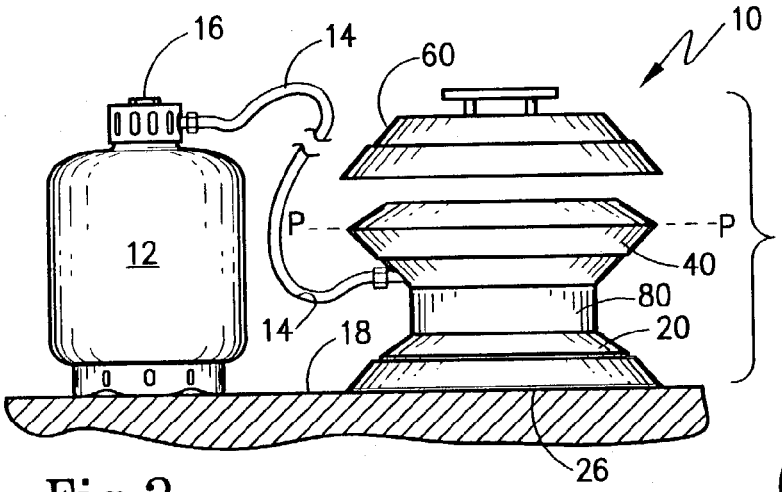
FIG. 2 is a side view in elevation of the campfire apparatus of FIG. 1 including the lid structure therefor.
Figure 3:
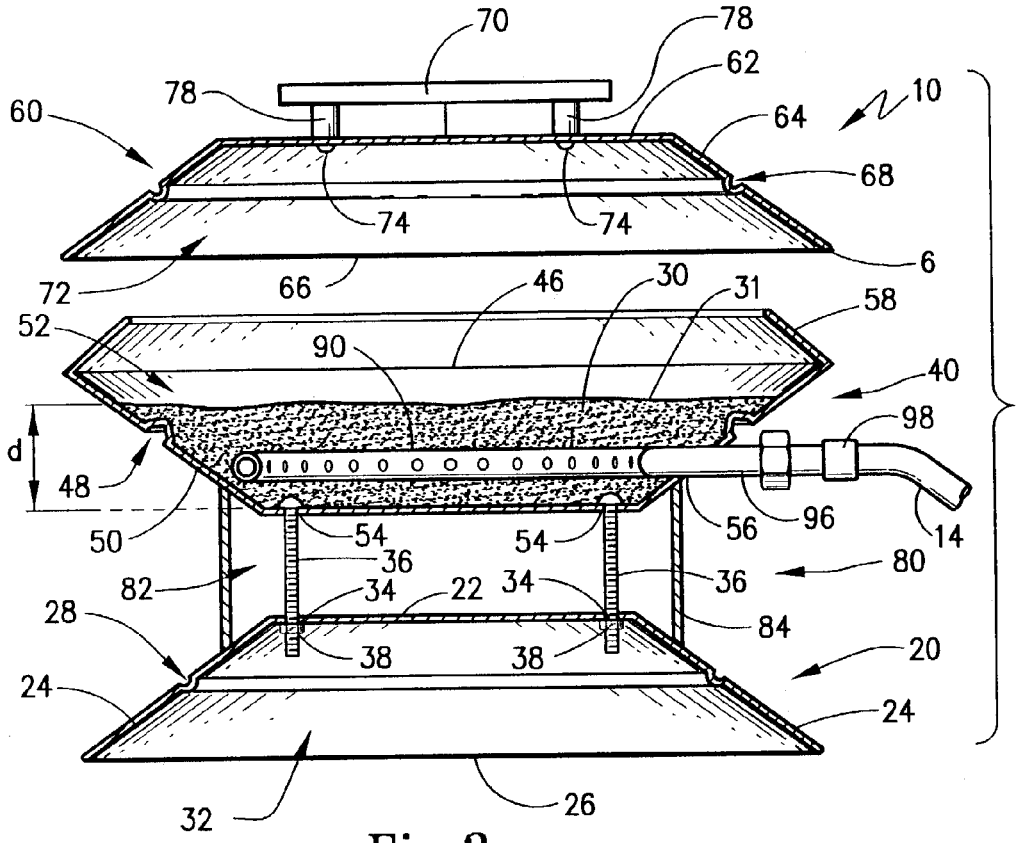
FIG. 3 is a rear view in cross-section showing the campfire apparatus of FIGS. 1 and 2.
Figure 4:
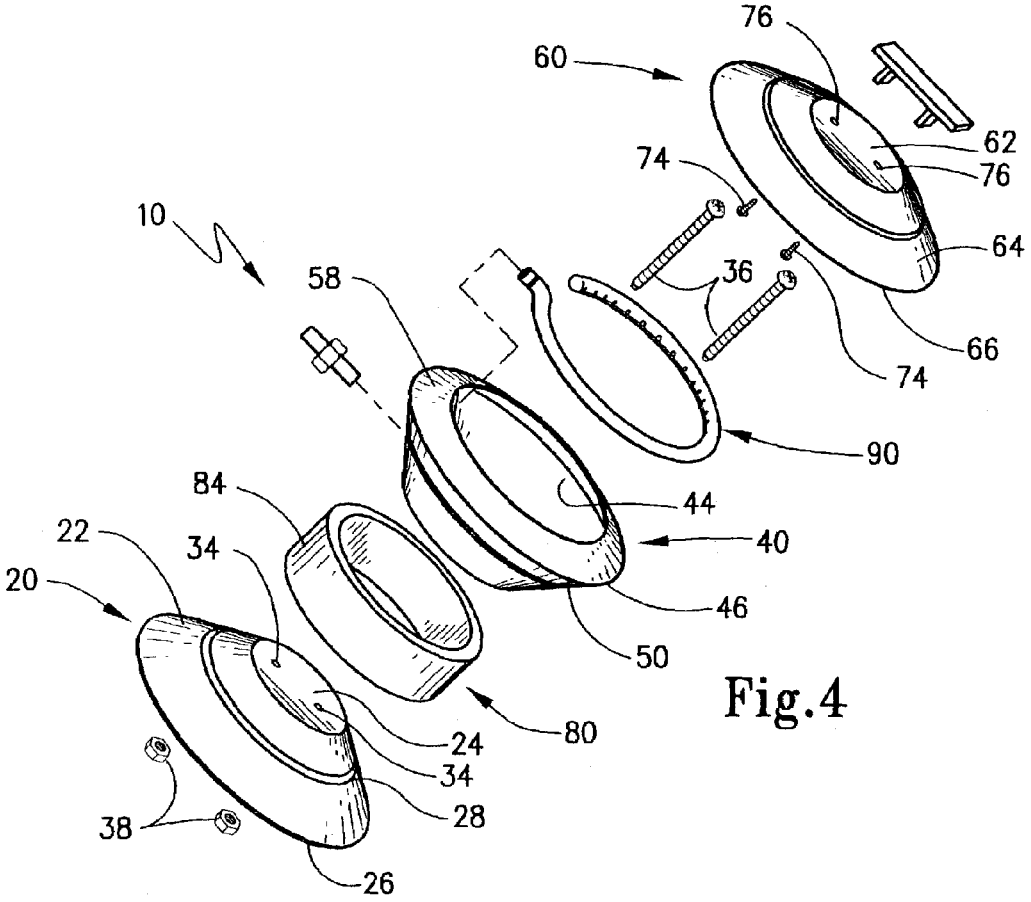
FIG. 4 is an exploded perspective view of the campfire apparatus of FIGS. 1–3.

Campfire apparatus 10 is shown in greater detail in FIGS. 2–4. In these Figures, it may be seen that campfire apparatus 10 includes a base 20, a fire pan 40, a lid 60 and a spacer 80. Base 20 is preferably in the form of an inverted frustum having a circular flat wall 22 and a side wall 24 that is formed of a conic sections that extends from flat wall 22 to terminate in an edge 26. A reinforcing channel 28 may be formed in side wall 24, if desired. Edge 26 is adapted to rest on the support surface 18 when in the assembled state, as is shown in FIG. 2.

Fire pan 40 includes a main body portion 50 that is constructed substantially identically to base 20. Accordingly, fire pan 40 has a circular flat wall 42 and a side wall 44 formed as a conic section that terminates in an upper edge or rim 46. Reinforcing channel 48 again extends around a central portion of side wall 44. Flat wall 42 and side wall 44 thus form a frustum having an open interior 52 similar to open interior 32 of base 20.

When in the assembled state, spacer 80 is interposed between side walls 24 and 44 of base 20 and fire pan 40, respectively. To this end, spacer 80 has a cylindrical sidewall 84 and an open interior 82. Base 20 and fire pan 40 are releasably secured together by means of carriage bolts 36 and nuts 38 which extend through holes 34 and 54 formed, respectively, in flat walls 22 and 42. As noted, fire pan 44 is constructed substantially identically to base 20 except that fire pan 44 includes an opening 56 therethrough that is adapted to provide connection access for a manifold 90 discussed below. In addition, fire pan 40 has an annular shoulder portion 58 welded or otherwise formed at upper rim 46 with shoulder portion 58 extending continuously around the fire pan 40 and being operative to support lid 60 thereon when the lid is in the mounted state.

Lid 60 is likewise formed substantially identically to base 20 and fire pan 40. Thus, as is best shown in FIG. 3, lid 60 has a circular flat wall 62 and a side wall 64 formed as a conic section so that lid 60 is frustoconical in shape with an open lid interior 69. Side wall 64 extends from flat plate 62 to terminate in a rim 66. Reinforcing channel 68 may again be formed in side wall 64. Lid 60 sports a handle 70 that is secured to flat wall 62 by means of screws 74 extending through holes 76 into legs 78 of handle 70. Lid 60 is sized and adapted to enclose the pan interior when placed thereon in a mounted state with a portion of the lid being supported by shoulder portion 58.

Figure 5:
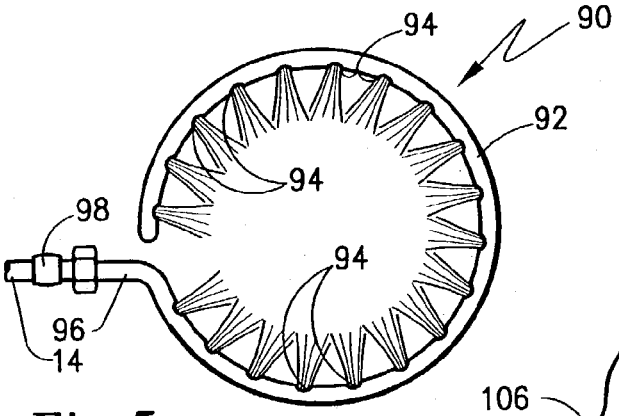
FIG. 5 is a top plan view of a first exemplary embodiment of a gas manifold for the campfire apparatus of FIGS. 1–4.

Manifold 90 is best shown in FIGS. 3–5. Manifold 90 includes a toroidal main body 92 provided with a plurality of ports, such as ports 94, that form a plurality of gas outlets operative to introduce vaporized fuel into the pan interior 52 when connected to a source of fuel. To this end, toroidal main body 92 is hollow in cross-section and includes an extension 96 that may be disposed in and project out of hole 56 when campfire apparatus 10 is in the assembled state, as is shown in FIG. 3. Extension 96 is provided with a connector 98 that is operative to connect to a source of fuel when in the assembled state in a manner that is standard in the art.

As is shown in FIG. 5, the structure and orientation of ports 94 are such that the vaporized fuel is directed radially inwardly with main body portion 92 extending circumjacent the inner surface of fire pan 40 when in the assembled state. Thus, ports 94 direct the vaporized fuel laterally toward an axis that is perpendicular to the plane "P" containing rim 46 of fire pan 40. By being circumjacent, it is meant that the manifold extends proximately to the inner surface of side wall 44 of fire pan 40 when in the mounted state, as is shown in FIG. 3.

Figure 7:
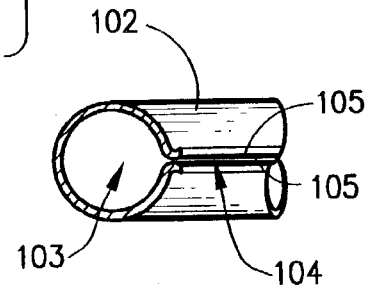
FIG. 7 is a cross-sectional view taken about lines 7—7 of FIG. 6.
Figure 6:
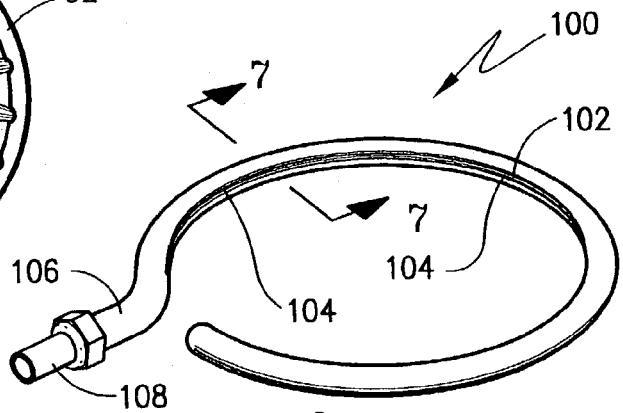
FIG. 6 is a perspective view of an alternative gas manifold for the campfire apparatus of FIGS. 1–4.

An alternative gas manifold for the campfire apparatus 10 is shown in FIGS. 6 and 7. Here, gas manifold 100 is structured substantially identically to gas manifold 90 and includes a hollow, toroidal shaped main body 102 having an interior 103. An extension 106 is adapted to project through opening 56 in side wall 44 of fire pan 40. As is shown best in FIG. 7, a slit 104 extends around the inner circumference of main body 102 to provide an outlet for vaporized fuel. Outwardly turned flanges 105 are in opposed facing relationship on either side of slit 104. Connector 108 is provided to attach to conduit 14 associated with fuel canister 12.

With reference to FIG. 3, it may be seen that campfire apparatus 10 also includes a quantity of low density, non-flammable particulate material 30 that is disposed in the fire pan 44 at a depth "d" that is sufficient to cover gas manifold 90 when in the assembled state so that manifold 90 is completely engulfed in the particulate material.

Preferably, the particulate material 30 possesses a sufficient amount of porosity to create and maintain vapor channels through and/or between the particles that permit the passage of gas through the particulate material 30. Particles of materials such as silicates, carbonates, coarse sands and certain ores possess sufficient gas porosity. More specifically, particles of clay, shale, slate, slag, zeolites, alumina hydrates, borates, perlite, vermiculite, beach sand, volcanic sand, sandblasting sand, and the like may be used. It should also be appreciated that certain types of silicates can be found both in an expanded or exfoliated form, as well as their crude or condensed form. This invention contemplates each of these various forms of silicates.

The preferred particulate material is vermiculite. Vermiculite is selected due to its property of permitting passage of the vaporized gas so that it migrates upwardly through the particulate material without igniting until it reaches surface 31 thereof. Moreover, vermiculite has been found to provide a matrix for the vaporized fuel that does not itself absorb heat or have a great thermal capacity. Thus, even when the fuel is ignited, the vermiculite material remains relatively cool to the touch. Moreover, the vermiculite does not produce embers that are discharged from campfire apparatus 10 when the fuel is ignited. Thus, there is a less potential for rogue fires resulting from embers being blown out of campfire apparatus 10. This is especially advantageous where the campfire apparatus 10 is used in a delicate, dry environment, such as a desert or arid camping area.

Figure 8:
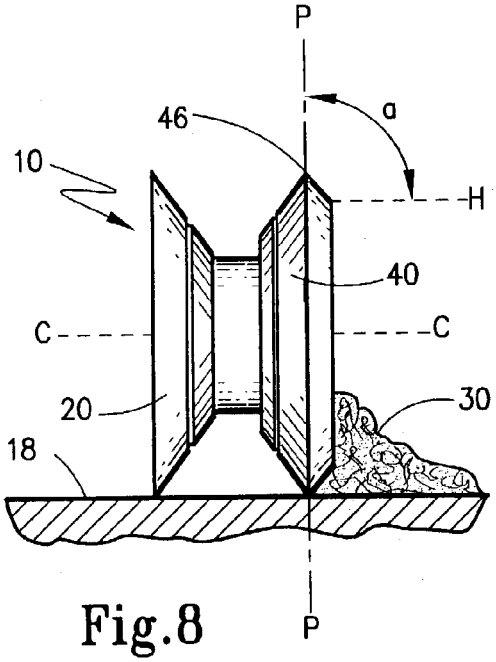
FIG. 8 is a side view in elevation of the campfire apparatus of FIGS. 1–4 shown in a tipped orientation.

In addition, as is illustrated in FIG. 8, another advantage of campfire apparatus 10 may be appreciated. Here, it may be seen that, by constructing base 20 and fire pan 40 substantially identically, with their central axes "C" aligned, the plane "P" of rim 46 of fire pan 40 is oriented at a perpendicular angle "a" with respect to the horizontal plane "H" when support surface 18 is horizontal and the campfire apparatus is tipped over. Should campfire apparatus 10 be purposelessly or inadvertently placed in a tipped condition, as is shown in FIG. 8, the vermiculite material 30 may spill out of fire pan 40 and remain in a fairly consolidated mass. It is also been found that, with the construction of campfire apparatus 10 as described with reference to FIGS. 1–5, the flame from manifold 90 will become extinguished. Thus, any open fire in fire pan 40 will be extinguished with the vermiculite 30 forming a non-threatening mass, that is, a mass that is not likely to inadvertently spread unwanted fire.

Figure 9:
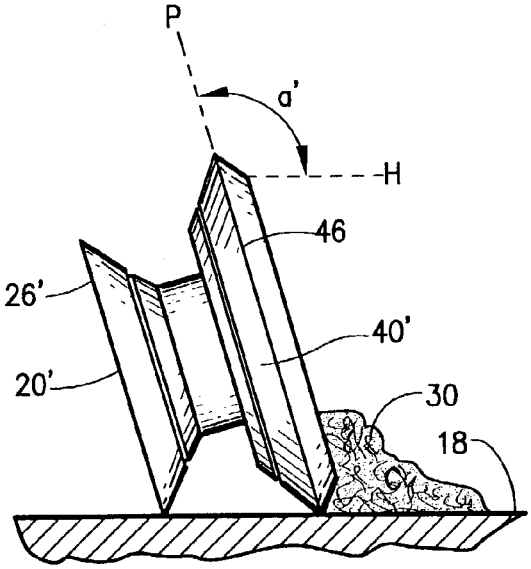
FIG. 9 is a side view in elevation, similar to FIG. 8, showing a tipped orientation of an alternative campfire apparatus wherein the base is smaller in dimension than the fire pan.

With reference to FIG. 9, it may be noted that base 20' in this embodiment has an edge 26' that is smaller in diameter than rim 46 of fire pan 40'. Accordingly, plane "P" is oriented at an angle "a'" with respect to the horizontal plane "H", that is, at an obtuse angle. Here again, the particulate mass 30 remains consolidated. Accordingly, it should be appreciated that, according to the present invention, a feature is having the rim of the fire pan 40 extend in a plane parallel to the support surface when in an upright position and, when in a tipped over position, the plane is oriented at no less than 90° to the support surface.

Figure 10:
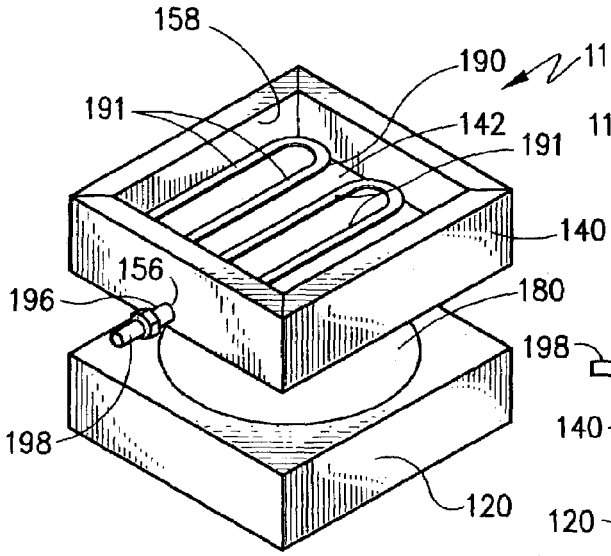
FIG. 10 is a perspective view of an alternative embodiment of a campfire apparatus according to the present invention.
Figure 11:
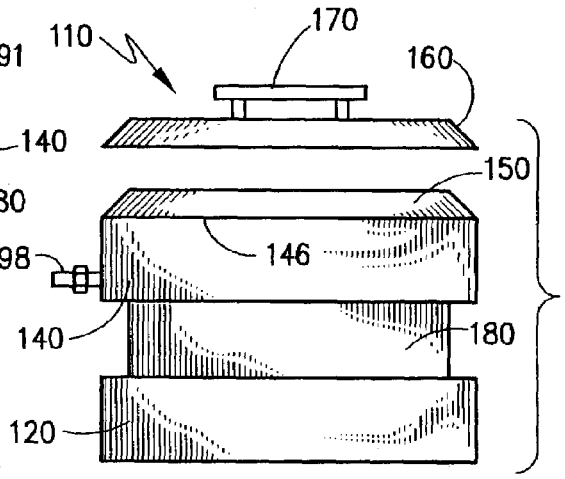
FIG. 11 is a side view in elevation of the campfire apparatus of FIG. 10 including a lid structure therefor.

With reference now to FIGS. 10 and 11, a second alternative embodiment of the present invention is shown. Here, campfire apparatus 110 is square-shaped so that the base 120 and the fire pan 140 are each structured as a rectangular (square) parallelepiped shell while spacer 180 is structured as a cylindrical shell. Serpentine manifold 190 is disposed in fire pan 140, near the square, flat wall 142. As best shown in FIG. 10, serpentine manifold 190 has a series of linear segments 191 extending from side-to-side in fire pan 140. Extension 196 of serpentine manifold 190 projects outwardly through opening 156 and is provided with a connector 198 so that it may be connected to a fuel source. A shoulder portion 158 in the form of a truncated pyramid projects upwardly and inwardly from rim 146 of fire pan 140. Shoulder portion 158 is adapted to support the truncated pyramid-shaped lid 160. Lid 160 is again provided with a handle 170 to facilitate removal and placement on campfire apparatus 110. Vermiculite (not shown) should be employed to a depth sufficient to cover manifold 190.

Figure 12:
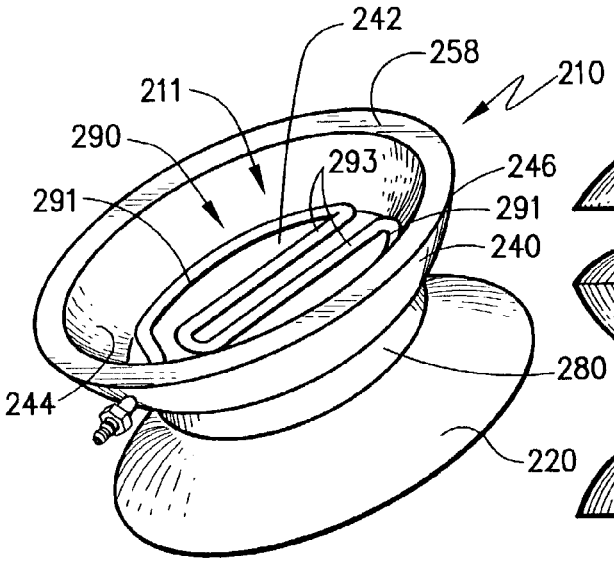
FIG. 12 is a perspective view of another alternative embodiment of a campfire apparatus according to the present invention.
Figure 13:
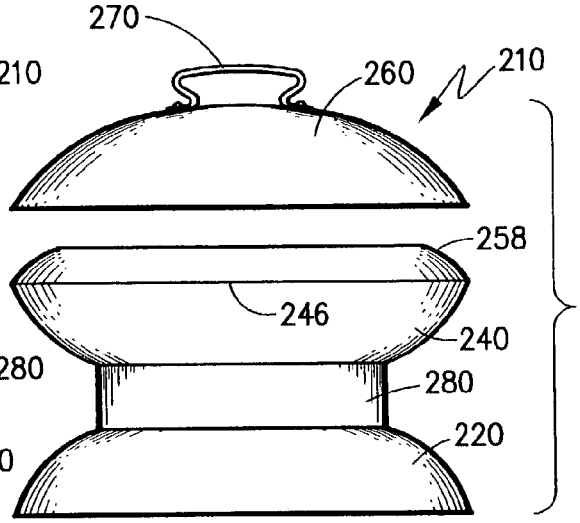
FIG. 13 is a side view in elevation of the campfire apparatus of FIG. 12 shown with its lid structure.
Figure 14:
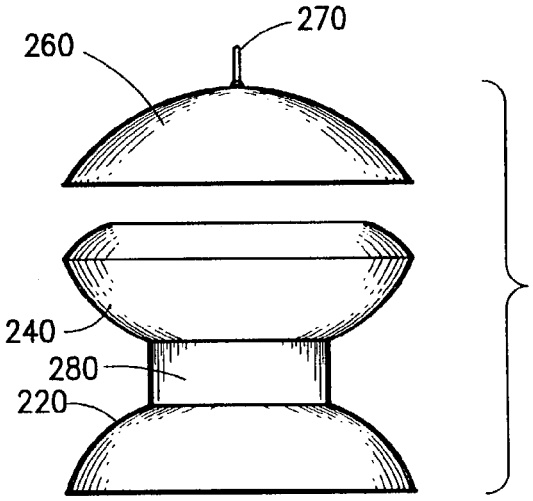
FIG. 14 is an end view in elevation of the campfire apparatus of FIG. 13.

A third exemplary embodiment of the present invention is shown in FIGS. 12–14. Here, camp stove or campfire apparatus 210 is formed to have an ovoid opening 211 formed by shoulder portion 258 extending from rim 246 of fire pan 240. Fire pan 240 and base 220 are formed as curvilinear shells with an oval or elliptical cross-section. Spacer 280 is in the form of an oval cross-section shell and is supported in base 220. Spacer 280 in turn supports fire pan 240, and a lid 260 is provided to rest on shoulder 258. Lid 260 is provided with handle 270 which may be configured as desired. A manifold 290 is placed in closely spaced relation to bottom wall 242 of fire pan 240 and is again in a serpentine configuration. Manifold 290 is again serpentine in configuration and it has actuate sections 291 that extend adjacent to side wall 244 of fire pan 240 as well as linear sections 293 that extend lengthwise in fire pan 240. While the embodiment of campfire apparatus 210 is shown to have an oval opening, it should be appreciated that this opening could be circular without departing from the scope of the invention. Thus, base 220, fire pan 240 and lid 260 could be formed as portions of a spherical shell, if desired.

Figure 15:
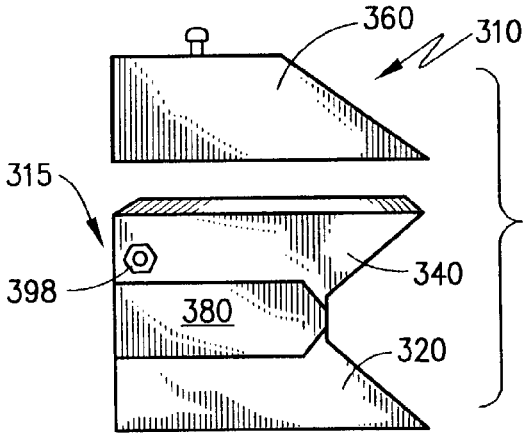
FIG. 15 is a side view in elevation of yet another alternative embodiment of a campfire apparatus according to the present invention.
Figure 17:
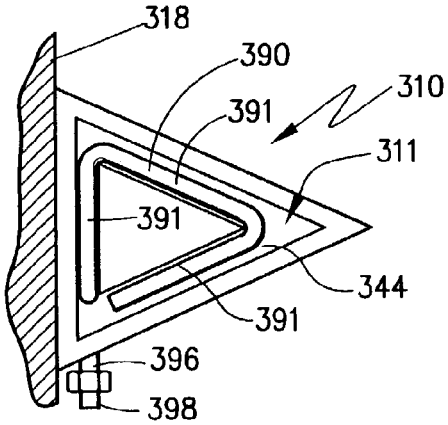
FIG. 17 is a top plan view of the campfire apparatus of FIGS. 15 and 16 shown without the lid structure therefor.
Figure 16:
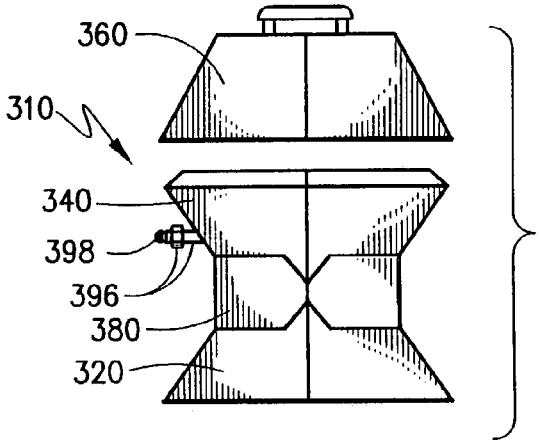
FIG. 16 is an end view in elevation of the campfire apparatus of FIG. 15.

Yet another exemplary embodiment of the present invention is shown in FIGS. 15–17. Here, campfire apparatus 310 has a triangular opening 311. Each of base 320, fire pan 340 and lid 360 are structured as truncated triangular pyramidal shells with fire pan 340 being supported by spacer 380 on base 320. As is shown in FIG. 17, the pyramid shape of base 320, fire pan 340 and lid 360 is skewed so that side 315 can be placed against a support wall 318, if desired. Manifold 390 is positioned in the interior of fire pan 340, similar to that described above and includes three legs 391 that are circumjacent side wall 344 of fire pan 340. Thus, manifold 390 is in the shape that is linearly angled. By this it is meant that the manifold is formed as linear sections wherein adjacent ones of the sections are oriented at an angle with respect to one another. An extension 396 of manifolds 390 projects outwardly of fire pan 340 and includes a gas connector 398, as described above.

Figure 19:
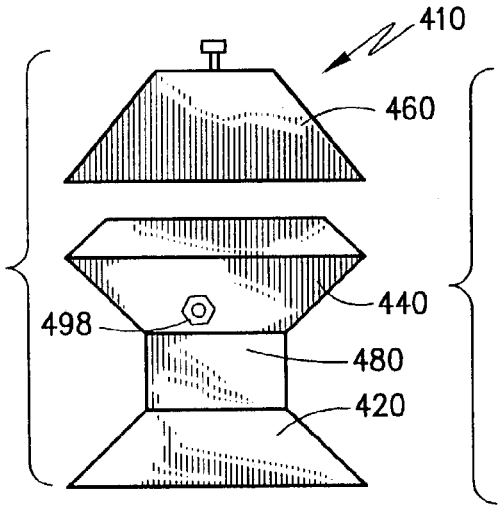
FIG. 19 is an end view in elevation of the campfire apparatus of FIG. 18.
Figure 18:
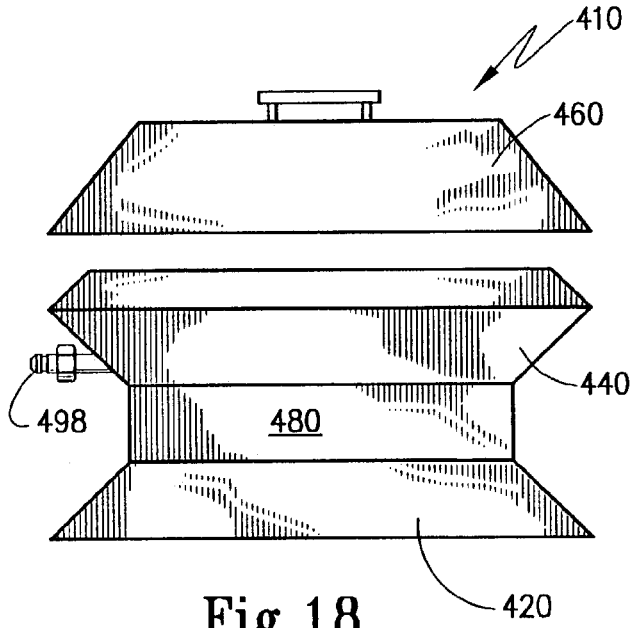
FIG. 18 is a side view in elevation of still a further alternative exemplary embodiment of a campfire apparatus according to the present invention.
Figure 20:
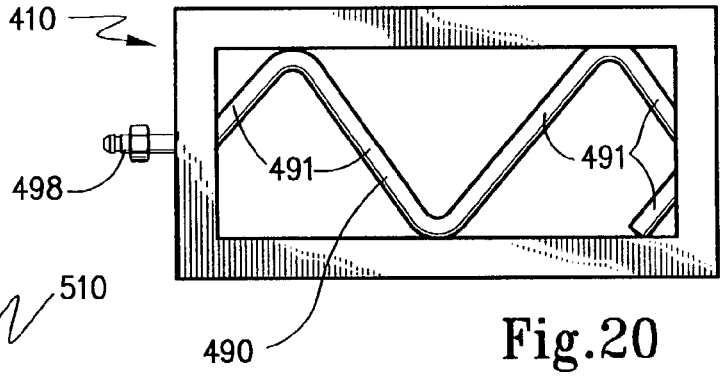
FIG. 20 is a top plan view of the campfire apparatus of FIGS. 18 and 19 shown without the lid structure therefor.

With reference now to FIGS. 19–20, another embodiment is shown wherein a campfire apparatus 410 includes a base 420, a fire pan 440 supported by a spacer 480 and a lid 460 for the fire pan 440. Here, the structure is similar to that described above as to the other embodiments. However, campfire apparatus 410 has a non-square rectangular opening with each of base 420, fire pan 440 and lid 460 being formed as truncated rectangular pyramid shells. With reference to FIG. 20, it may be seen that manifold 490 is again a linearly angled shape adjacent linear sections 491 formed at an angle with respect to adjacent linear angled sections. Connector 498 is again provided to connect to a source of fuel.

Figure 21:
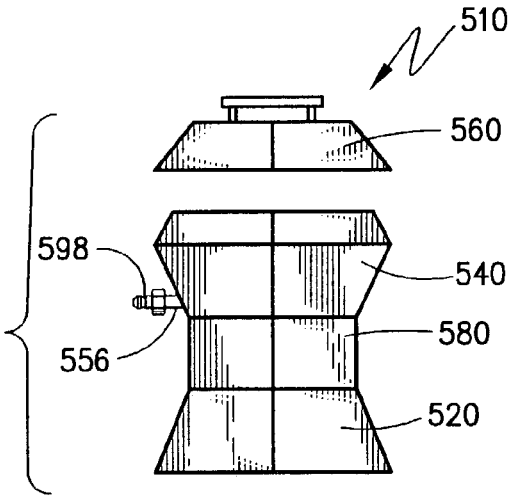
FIG. 21 is a side view in elevation showing a final exemplary embodiment of a campfire apparatus according to the present invention.
Figure 22:
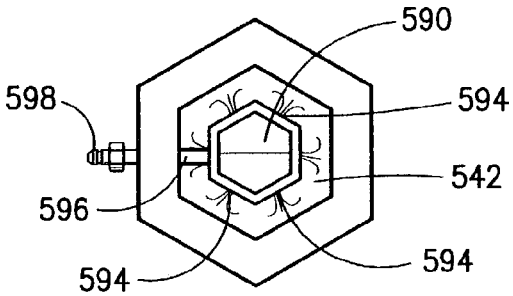
FIG. 22 is a top plan view of the campfire apparatus of FIG. 21 shown without the lid structure therefor.

Finally, with reference to FIGS. 21 and 22, yet another campfire apparatus 510 is shown. Campfire apparatus 510 is hexagonal in configuration so that base 520, fire pan 540 and lid 560 are each constructed as truncated pyramidal shells having a hexagonal base. Spacer 580 is interposed between base 520 and fire pan 540 so that fire pan 540 is supported by spacer 580 that is in turn supported on base 520. In FIG. 22, it may be seen that the manifold 590 is in the form of a burner that is disposed adjacent to bottom wall 542. Manifold 590 has ports 594 that project radially outwardly so as to disperse vaporized fuel therefrom into the vermiculite mass (not shown) that is adapted to cover manifold 590. Again, a suitable extension tube 596 extends outwardly through opening 556 to interconnect manifold 590 and gas connector 598.

From the foregoing, it should be understood that the shape of the base, the fire pan and the lid of campfire apparatus of the present invention can take a variety of geometric configurations, all believed to be within the scope of the ordinarily skilled artisan having now read the above description. For example, this configuration may be a portion of a spherical shell or shell of other curvilinear configuration, a truncated pyramidal shell, a rectangular (or square) parallel piped shell, a polyhedron shell, a conical shell, a cylindrical shell or a pyramidal shell. Likewise, the configuration of the manifold may be selected as appropriate and, again, is within the skill of the ordinary artisan having read this description. For example, the manifold may be a toroidal shape, a serpentine shape, a linear shape or a linearly angled shaped without departing from the scope of the present invention.

Further, from the above description, it should be appreciated that the present invention contemplates a method of providing a portable campfire on a support surface. This method includes any of the steps inherent in the above described apparatus. In particular, the method according to the present invention includes the step of providing a fire pan having an interior and wherein the interior and a gas manifold disposed in the interior. This manifold has at least one gas outlet operative to introduce vaporized fuel into the interior of the fire pan. The method also includes the step of supporting the fire pan in spaced relation to the support surface so that the interior of the fire pan is upwardly opening. Next, the method includes the step of placing a quantity of low density, fire retardant particulate material in the fire pan at a depth sufficient to cover the gas manifold thereby to achieve a surface space completely above the gas manifold. The method then includes the step of introducing a fuel into the manifold at a pressure sufficient so that vaporized fuel is injected into the particulate material in a manner whereby the vaporized fuel migrates upwardly therethrough without igniting until it reaches the surface of the particulate material. Finally, the method includes the step of igniting the vaporized fuel along the surface of the particulate material. In addition to these general steps, the method according to the present invention includes the selection of particles of materials such as silicates, carbonates, coarse sand and certain ores. Preferably, the particulate material according to the method is vermiculite.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiment of the present invention without departing from the inventive concepts contained herein.

I claim:

1. A campfire apparatus adapted to be placed in an assembled state on a support surface and connected to a source of fuel, comprising:

(a) a base adapted to rest on the support surface when in the assembled state;

(b) a fire pan adapted to be supported by said base when in the assembled state, said fire pan including a main body portion having an inner surface, an upper rim and a pan interior;

(c) a spacer adapted to be interposed between said fire pan and said base when in the assembled state so that said base supports said spacer and said spacer supports said fire pan;

(d) a gas manifold disposed in said fire pan when in the assembled state, and having at least one gas outlet operative to introduce vaporized fuel into the pan interior when connected to the source of fuel; and (e) a quantity of low-density, non-flammable particulate material adapted to be disposed in said fire pan at a depth sufficient to cover said gas manifold when in the assembled state.

2. A campfire apparatus according to claim 1 including a connector associated with said gas manifold and adapted to connect to the source of fuel when in an assembled state.

3. A campfire apparatus according to claim 1 wherein said particulate material is selected from a group consisting of clay, shale, slate, and slag particles, zeolites, alumina hydrates, borates, perlite, vermiculite, beach sand, volcanic sand and sandblasting sand.

4. A campfire apparatus according to claim 1 wherein said particulate material is vermiculite.

5. A campfire apparatus according to claim 1 including a lid sized and adapted to enclose said pan interior when placed thereon in a mounted state, with a portion of said lid being supported by a portion of said main body.

6. A campfire apparatus according to claim 5 wherein said upper rim extends continuously around said fire pan and including an inwardly projecting shoulder portion disposed on said upper rim, said shoulder portion operative to support said lid when said lid is in the mounted state.

7. A campfire apparatus according to claim 1 wherein said gas manifold has a selected size and a shape selected from a group consisting of toroidal, serpentine, linear and linearly angled shapes.

8. A campfire apparatus according to claim 1 wherein said gas manifold is shaped so as to extend circumjacent to the inner surface of said fire pan when in the assembled state and operative when connected to a source of fuel to direct vaporized fuel laterally toward an axis that is perpendicular to the plane containing the rim of said fire pan.

9. A campfire apparatus according to claim 8 including a plurality of ports formed in spaced apart relation to one another around said gas manifold thereby to define a plurality of gas outlets therefor.

10. A campfire apparatus according to claim 1 wherein said fire pan is configured as a geometric shell selected from a group consisting of: a portion of a spherical shell, a truncated pyramidal shell, a rectangular parallelepided shell, a polyhedral shell, a conical shell, a cylindrical shell and a pyramidal shell.

11. A campfire apparatus according to claim 10 wherein said fire pan, and said base are of substantially the same size and shape.

12. A campfire apparatus according to claim 11 including a lid sized and adapted to enclose said pan interior when placed thereon in a mounted state with a portion of said lid being supported by a portion of said main body, and wherein said lid has substantially the same geometric structure as said fire pan and said base.

13. A campfire apparatus according to claim 1 wherein said upper rim extends in a plane parallel to said support surface when in an upright position, and when in a tipped-over position, the plane of said upper rim is oriented at no less than ninety degrees to said support surface.

14. A portable camping stove adapted to be placed on a support surface and connect to a source of fuel, comprising:

(a) a base adapted to rest on a support surface, said base constructed as a base shell with a lower rim so as to have a base interior, said base having a selected geometric configuration and size;

(b) a fire pan including a main body portion constructed as a fire pan shell with an upper rim so as to have a pan interior, said fire pan shell having a selected geometric configuration and size, said base and said fire pan being securable to one another so that the base interior and the pan interior are oppositely opening; and (c) a gas manifold disposed in the pan interior and having at least one gas outlet operative to introduce vaporized fuel into the pan interior when connected to the source of fuel.

15. A portable camping stove according to claim 14 including a connector associated with said gas manifold and adapted to connect to a source of fuel.

16. A portable camping stove according to claim 14 including a spacer having a hollow interior and interposed between said base and said fire pan.

17. A portable camping stove according to claim 14 wherein said fire pan has a central pan axis and said base has a central base axis, said base and said fire pan secured together such that the central base axis and said central pan axis are co-linear.

18. A portable camping stove according to claim 17 including a spacer having a hollow interior and interposed between said base and said fire pan and at least one bolt interconnecting said fire pan and said base, said bolt passing through the interior of said spacer.

19. A portable camping stove according to claim 14 including a lid sized and adapted to enclose said interior pan when placed thereon in a mounted state with a portion of said lid being supported by a portion of said main body.

20. A portable camping stove according to claim 19 including an inwardly projecting shoulder portion disposed on said upper rim and extending continuously around said fire pan, said shoulder portion adapted to support said lid when in a mounted state.

21. A portable camping stove according to claim 14 including a plurality of ports formed in spaced-apart relation to one another around said gas manifold thereby to define a plurality of gas outlets therefor or.

22. A portable camping stove adapted to be placed on a support surface and connect to a source of fuel, comprising:

(a) a fire pan including a main body portion constructed as a fire pan shell having a central pan axis and with an upper rim and a pan interior, said fire pan shell having a selected geometric configuration and size;

(b) a base operative to rest on the support surface, said base constructed as a base shell having a central base axis and with a lower rim and a base interior, said base shell having the selected geometric configuration and size;

(c) a spacer formed as a hollow connector and interposed between said fire pan and said base such that when connected together, the central pan axis and the central base axis are co-linear and the pan interior and the base interior are in an opposed relationship;

(d) a gas manifold disposed in the interior of said fire pan and having at least one gas outlet operative to introduce vaporized fuel into the interior of said fire pan when connected to the source of fuel;

(e) a connector associated with said gas manifold and adapted to connect to the source of fuel;

(f) a lid constructed as a lid shell having the selected geometric configuration and size; and (g) a quantity of low density, fire-retardant material disposed in said fire pan at a depth sufficient to cover said gas manifold.

23. A campfire apparatus adapted to be placed in an assembled state on a support surface, comprising:

(a) a base adapted to rest on the support surface when in the assembled state;

(b) a fire pan adapted to be releasably secured to said base and supported thereby when in the assembled state, said fire pan including a main body portion having an inner surface, an upper rim and a pan interior;

(c) a reservoir adapted to provide a source of fuel;

(d) a gas manifold adapted to be disposed in the pan interior when in the assembled state, and having at least one gas outlet operative to introduce vaporized fuel into the pan interior when connected to said source of fuel; and (e) a quantity of vermiculite adapted to be disposed in said fire pan at a depth sufficient to cover said gas manifold when in the assembled state.

24. A method of providing an artificial campfire on a support surface, comprising the steps of:

(a) providing a fire pan having an interior and wherein said fire pan includes a gas manifold disposed in the interior thereof with said manifold having at least one gas outlet operative to introduce vaporized fuel into the interior of said fire pan;

(b) positioning said fire pan in spaced relation above a base support disposed on the support surface;

(c) securing said fire pan to said base such that the interior of said fire pan is upwardly opening;

(d) placing a quantity of low density, fire retardant particulate material in said fire pan at a depth sufficient to cover said gas manifold thereby to achieve a surface spaced completely above said gas manifold;

(e) introducing a fuel into said gas manifold at a pressure sufficient so that vaporized fuel is injected into the particulate material in a manner whereby the vaporized fuel migrates upwardly therethrough without igniting until it reaches the surface; and (f) igniting said vaporized fuel along the surface of said particulate material.

25. A method according to claim 24 wherein said particulate material is selected from a group consisting of clay, shale, slate, and slag particles, zeolites, alumina hydrates, borates, perlite, vermiculite, beach sand, volcanic sand and sandblasting sand.

26. A method according to claim 25 wherein said particulate material is vermiculite.

27. A campfire apparatus adapted to be placed in an assembled state on a support surface and connected to a source of fuel, comprising:

(a) a base adapted to rest on the support surface when in the assembled state;

(b) a fire pan adapted to be supported by said base when in the assembled state, said fire pan including a main body portion having an inner surface, an upper rim and a pan interior, wherein said upper rim extends continuously around said fire pan and including an inwardly protecting shoulder portion disposed on said upper rim, said shoulder portion operative to support said lid when said lid is in the mounted state;

(c) a lid sized an adapted to enclose said pan interior when in the assembled state, with a portion of said lid being supported by a portion of said main body;

(d) a gas manifold disposed in said fire pan when in the assembled state, and having at least one gas outlet operative to introduce vaporized fuel into the pan interior when connected to the source of fuel; and (e) a quantity of low-density, non-flammable particulate material adapted to be disposed in said fire pan at a depth sufficient to cover said gas manifold when in the assembled state.

28. A campfire apparatus adapted to be placed in an assembled state on a support surface and connected to a source of fuel, comprising:

(a) a base adapted to rest on the support surface when in the assembled state;

(b) a fire pan adapted to be supported by said base when in the assembled state, said fire pan including a main body portion having an inner surface, an upper rim and a pan interior, said base and said fire ran being securable to one another;

(c) a gas manifold disposed in said fire pan when in the assembled state, and having at least one gas outlet operative to introduce vaporized fuel into the pan interior when connected to the source of fuel and shaped so as to extend circumjacent to the inner surface of said fire pan when in the assembled state and operative when connected to a source of fuel to direct vaporized fuel laterally toward an axis that is perpendicular to a plane containing the upper rim of said fire pan; and (d) a quantity of low-density, non-flammable particulate material adapted to be disposed in said fire pan at a depth sufficient to cover said gas manifold when in the assembled state.

29. A campfire apparatus according to claim 28 including a plurality of ports formed in spaced apart relation to one another around said gas manifold thereby to define a plurality of gas outlets therefor.

30. A campfire apparatus adapted to be placed in an assembled state on a support surface and connected to a source of fuel, comprising:

(a) a base adapted to rest on the support surface when in the assembled state, said base having a central base axis;

(b) a fire pan, securable to said base and adapted to be supported by said base when in the assembled state, said fire pan including (1) a main body portion having an inner surface and an aperture formed therethrough (2) an upper rim; and (3) a pan interior;

(c) a gas outlet received by the aperture in said fire pan that is operative to introduce vaporized fuel into the pan interior when connected to the source of fuel; and (d) a quantity of low-density, non-flammable particulate material disposed in said fire pan.

31. A campfire apparatus adapted to be placed in an assembled state on a support surface and connected to a source of fuel, comprising:

(a) a base adapted to rest on the support surface when in the assembled state;

(b) a fire pan adapted to be supported by said base when in the assembled state, said fire pan including a main body portion having an inner surface, an upper rim and a pan interior;

(c) a detachable spacer adapted to be supported by said base and to support said fire pan when in the assembled state;

(d) a gas manifold disposed in said fire pan when in the assembled state, and having at least one gas outlet operative to introduce vaporized fuel into the pan interior when connected to the source of fuel; and (e) a quantity vermiculite adapted to be disposed in said fire pan at a depth sufficient to cover said gas manifold when in the assembled state.

32. A campfire apparatus adapted to be placed in an assembled state on a support surface and connected to a source of fuel, comprising:

(a) a base adapted to rest on the support surface when in the assembled state, said base having a selected geometric size and shape;

(b) a fire pan having a substantially similar geometric size and shape as said base, said fire pan adapted to be supported by said base when in the assembled state, said fire pan including a main body portion having an inner surface, an upper rim and a pan interior;

(c) a spacer adapted to be interposed between said fire pan and said base when in the assembled state so that said base supports said spacer and said spacer supports said fire pan;

(d) a gas manifold disposed in said fire pan when in the assembled state, and having at least one gas outlet operative to introduce vaporized fuel into the pan interior when connected to the source of fuel; and (e) a quantity of low-density, non-flammable particulate material adapted to be disposed in said fire pan at a depth sufficient to cover said gas manifold when in the assembled state.

33. A campfire apparatus according to claim 24 wherein said particulate material is vermiculite.

34. A campfire apparatus adapted to be placed in an assembled state on a support surface and connected to a source of fuel, comprising:

(a) a base adapted to rest on the support surface when in the assembled state;

(b) a fire pan adapted to be supported by said base when in the assembled state, said fire pan including a main body portion having an inner surface, an upper rim and a pan interior;

(c) a lid sized an adapted to enclose said pan interior when in the assembled state, with a portion of said lid being supported by a portion of said main body;

(d) a gas manifold disposed in said fire pan when in the assembled state, and having at least one gas outlet operative to introduce vaporized fuel into the pan interior when connected to the source of fuel; and (e) a quantity of low-density, non-flammable particulate material adapted to be disposed in said fire pan at a depth sufficient to cover said gas manifold when in the assembled state.

* * * * *